US005281093A

United States Patent [19]

Sedlak et al.

[11] Patent Number: 5,281,093

[45] Date of Patent: Jan. 25, 1994

[54] FAN BLADE COVER

[76] Inventors: Lois M. Sedlak, 16426 Pike Blvd., Brook Park, Ohio 44142; Doris A. Prucha, 6237 Mariana Dr., Parma Heights, Ohio 44130

[21] Appl. No.: 959,451

[22] Filed: Oct. 8, 1992

Related U.S. Application Data

[63] Continuation of Ser. No. 658,993, Feb. 21, 1991, abandoned.

[51] Int. Cl.[5] ..... B63H 1/00

[52] U.S. Cl. ..... 416/62; 416/146 R; 416/5

[58] Field of Search ..... 416/62, 146 R, 5; 24/385, 424, 431

[56] References Cited

U.S. PATENT DOCUMENTS

| | | | |
|---|---|---|---|
| 2,288,592 | 7/1942 | Mirhige | 416/146 R |
| 4,676,721 | 6/1987 | Hardee . | |
| 4,832,572 | 5/1989 | Prucha et al. . | |
| 5,048,160 | 9/1991 | Goodrich et al. | 24/306 |

*Primary Examiner*—Thomas E. Denion

*Attorney, Agent, or Firm*—Watts, Hoffmann, Fisher & Heinke

[57] ABSTRACT

A fan blade cover for use on fans having a plurality of fan blades, where one size cover fits many sizes and contours of fan blades. The cover includes a sleeve manufactured from a flexible material in a tubular configuration where one end of the sleeve is closed and an opposite end is open for mounting the cover on the fan blade. The open end of the sleeve includes a zipper for closing the open end to securely maintain the cover on the fan blade during fan operation. An alternate embodiment includes a clasp and drawstring to secure the fan blade cover in place.

12 Claims, 4 Drawing Sheets

FAN BLADE COVER

This application is a continuation of application Ser. No. 07/658,993, filed Feb. 21, 1991, now abandoned.

TECHNICAL FIELD

This invention relates to a covering for use with fan blades, for example, on the fan blades of ceiling fans.

BACKGROUND ART

Circulation fans are manufactured having blades of various shapes, sizes and materials. Manufacturers of the fans do not provide purchasers with protective coverings to surround the fan blades, and the fan blades are therefore open to the room and consequently readily visible to room occupants.

Because the fan blades are open to the room environment, substances such as dust, dirt and grease naturally tend to accumulate on the fan blades over a period of time, particularly on the surface of the blade located nearest the ceiling. Fans are used in a commercial or industrial setting and accumulate dirt rapidly due to the high level of particulate matter in the air. Fans positioned in residential kitchens are also subject to the more rapid accumulation of grease and dirt.

Ceiling mounted fans and fans in other elevated locations are difficult to clean and the top surface of the blades may be impossible to reach. Standing on a step ladder or stool was not only difficult, but dangerous.

Use of fan blade covers on fan blades permits safe and easy cleaning, since the covers may be simply removed from the blades when necessary and either inexpensively replaced or easily cleaned. The covers also serve to enhance the overall appearance of the fan and fan blades, as the color and pattern of the material may be selected to coordinate with room decor. Additional decorative trim may also be either removably or permanently attached to the covers, to further enhance fan and fan blade appearance.

Two prior art patents disclosing fan blade covers are U.S. Pat. No. 4,676,721 to Hardee and U.S. Pat. No. 4,832,572 to Prucha et al. The disclosure of the '572 patent to Prucha et al. is incorporated herein by reference.

DISCLOSURE OF THE INVENTION

The present invention concerns a protective cover for the fan blades of ceiling fans, where the protective cover is capable of fitting many sizes and contours of fan blades.

The cover comprises a tubular sleeve which is preferably manufactured of an inexpensive material capable of conforming to the blade portion of the fan blades. The sleeve has an opening that receives the fan blade as the cover is slipped over the blade. When mounted on the blade portion, the opening is associated with a shaft end of the fan blade which is attached to a central portion of the fan. The sleeve also includes a closed end portion which is associated with an outer end of the fan blade portion and which is spaced radially outward from the central portion of the fan.

In one embodiment of the invention, a zipper is used to close the sleeve's opening. When unzipped, the sleeve slips over an outer end of the fan blade to cover the blade portion. The zipper is then closed to maintain the cover on the blade as the fan blades rotate during fan operation.

An alternate embodiment of the invention uses a clasp and elastic band. Once the sleeve is slipped over the fan blade, the elastic band is stretched causing the sleeve's open end to contract about the fan blade. The stretched elastic band is then slipped around the clasp to hold the fan blade cover in place.

BEST MODE FOR CARRYING OUT THE INVENTION

Figure 1:
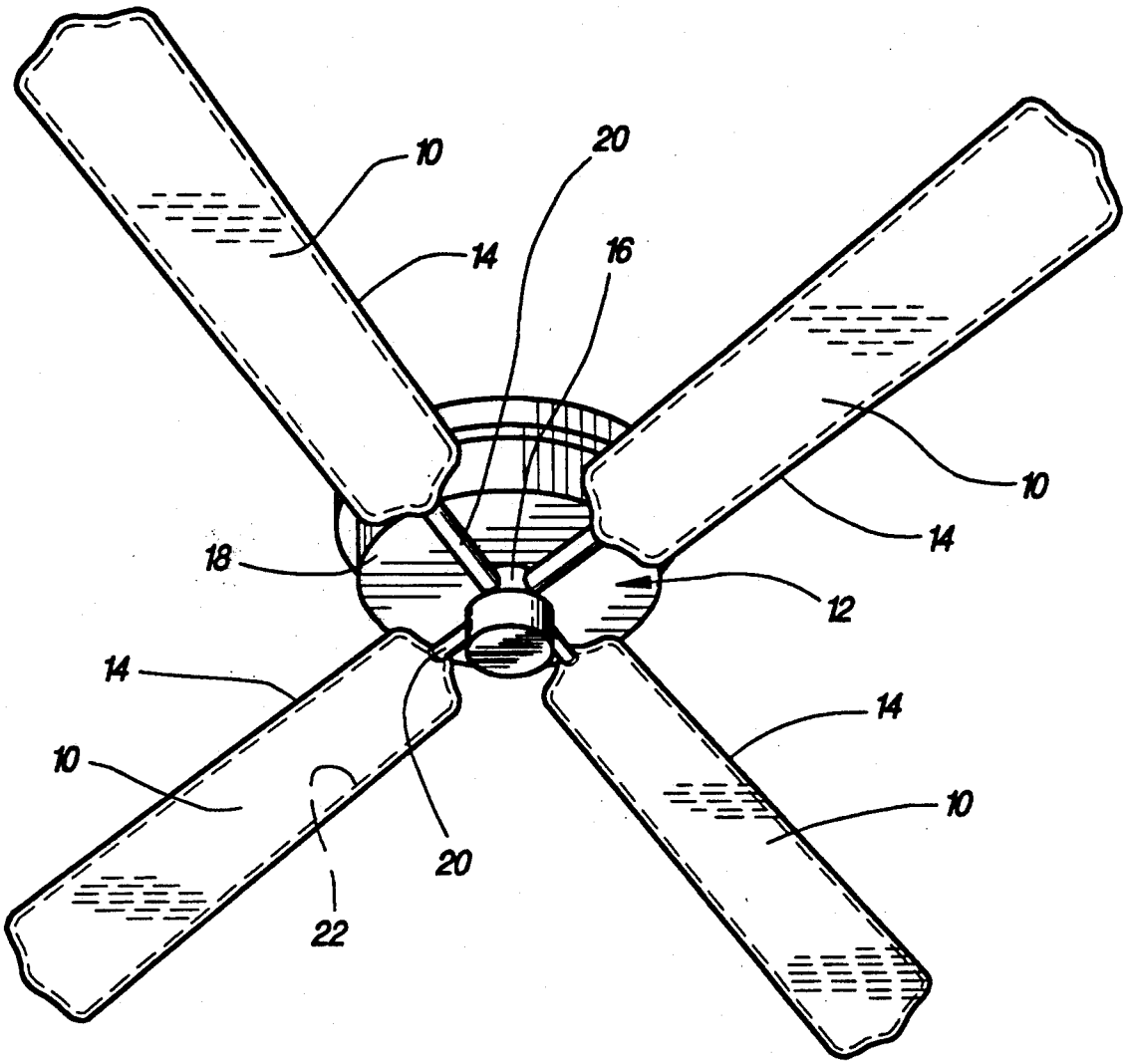
FIG. 1 is a perspective view of a ceiling fan with multiple fan blades having protective coverings.

A fan blade cover 10 constructed in accordance with the invention is illustrated in FIG. 1. Four such covers are shown mounted to equally spaced fan blades of a circulation fan 12 of the type mounted on the ceiling of a room. The four fan blades 14 extend radially from a central rotating shaft 16 of the fan 12. Internal fan components, such as the motor which rotates the shaft 16, are hidden by a housing 18, from which the rotary shaft 16 extends.

Figure 3:
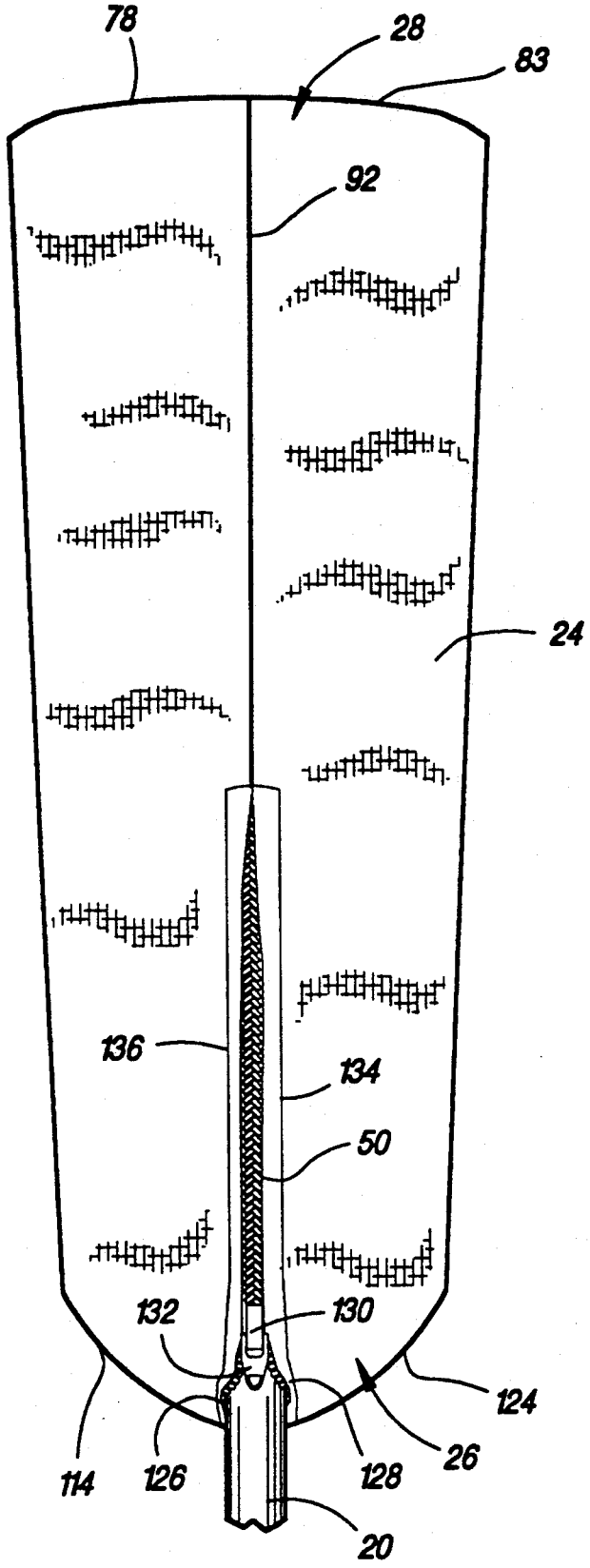
FIG. 3 is a plan view of a fan cover attached to a fan blade.
Figure 4:
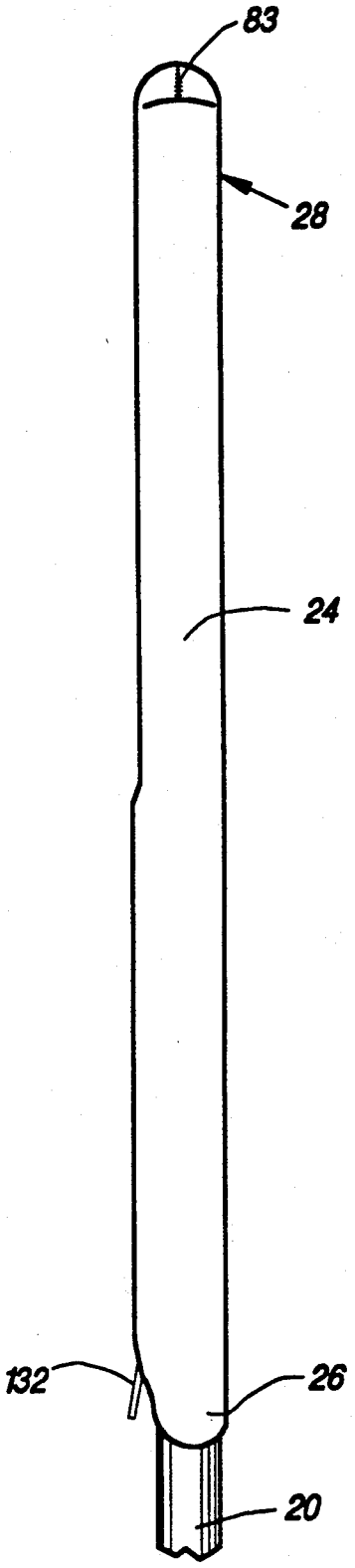
FIG. 4 is a side elevational view of the FIG. 3 fan blade cover.

The fan blades 14 include a blade portion 22 and a shaft portion 20 for interconnection with the rotary shaft 16 of the ceiling fan 12. The fan blades 14 can be purchased having a variety of sizes and differing contours. As shown in FIGS. 3 and 4, the fan blade cover 10 comprises a tubular sleeve 24 which may be readily mounted on the fan blade. The sleeve 24 has an open end 26 for receiving the blade portion 22, and a closed end 28 associated with an end of the fan blade which is spaced from the rotary fan shaft 16. The open end 26 of the fan blade cover 10 preferably includes a zipper 50 for closing the open end around the fan blade shaft 20 to secure the cover 10 in place as the fan blades 14 rotate during operation of the fan 12.

The cover 10 is fabricated from a flat piece of elastic material 60 known generally as spandex. Spandex comprises a material manufactured from a long chain synthetic polymer having at least 85% segmented polyurethane. It is commonly used in girdles, socks and hosiery.

Figure 2:
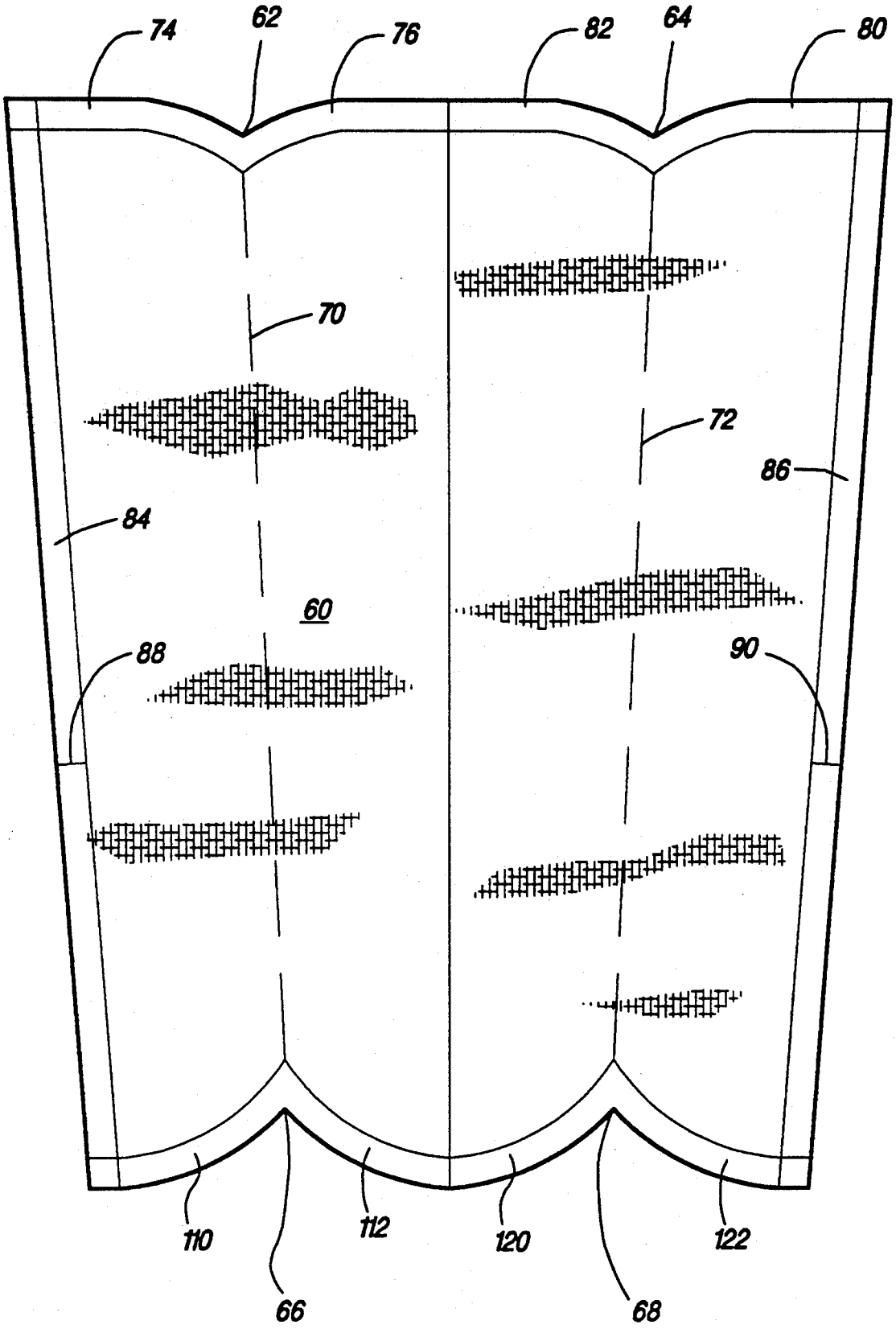
FIG. 2 is a plan view of a piece of material used to fabricate a fan blade cover constructed in accordance with one embodiment of the invention.

Top and bottom border portions of the piece 60 are formed by folding the material over itself. The material is cut using a pattern so that notches 62, 64, 66 and 68 are formed in these top and bottom borders. The material is folded over itself along two fold lines 70, 72 and sewn together. As seen in FIG. 2, when the material 60 is folded along the line 70 a closed end border segment 74 engages a second closed end border segment 76. Similarly, the two border segments 80, 82 engage each other when the material is folded along the line 72.

The segments 74, 76 are sewn together to form a seam 78 (See FIG. 3) and the segments 80, 82 are sewn together to form a seam 83. Two sides of the material are also folded over to form borders 84, 86 that are sewn together along sightly more than half the length of the cover. Two notches 88, 90 that extend into the material an amount equal to the width of the borders 84, 86, define an end point for a seam 92, which in combination with the seams 78, 83, forms the closed end 28 of the cover 10.

At the cover's open end, when the material is folded along the line 70, two arcuate border segments 110, 112 engage each other and are sewn together to form a seam 114. Two other arcuate border segments 120, 122 engage each other when the material is folded along the line 72 and are sewn together to form a seam 124.

The zipper 50 is a conventional zipper having two rows of engagable tabs 126, 128 that can be joined or separated by pulling a connector 130 back and forth. A pull 132 is attached to the connector 130 which can be more easily grasped by one opening and closing the cover.

The two rows of engagable tabs are mounted to two strips of binding (not shown). The binding strips are inserted into the cover 10 and sewn to the borders 86, 84 along two elongated seams 134, 136 (See FIG. 3).

The cover 10 may be easily mounted on the fan blade 14, by unzipping the zipper 50 at the open end 26 and physically sliding the sleeve 24 along the blade portion 22 until the sleeve 24 encases the blade portion 22 of the fan blade 14. When the sleeve is in the mounted position the zipper 50 is zipped close by grasping the pull 132 and drawing the connector 130 toward the fan blade shaft 20. When the connector reaches its end of travel the sleeve 10 surrounds the fan blade shaft 20. (See FIG. 3) When the fan blade cover 10 needs to be cleaned or it otherwise becomes necessary to remove the cover from the blade 14, the zipper is unzipped and the fan blade cover removed from its associated fan blade. The ease with which the cover 10 can be mounted and removed reduces the risk previously involved with cleaning fan blades, since it is not necessary to stand on a chair or step ladder to reach the blades 14 for long time periods.

Figure 5:
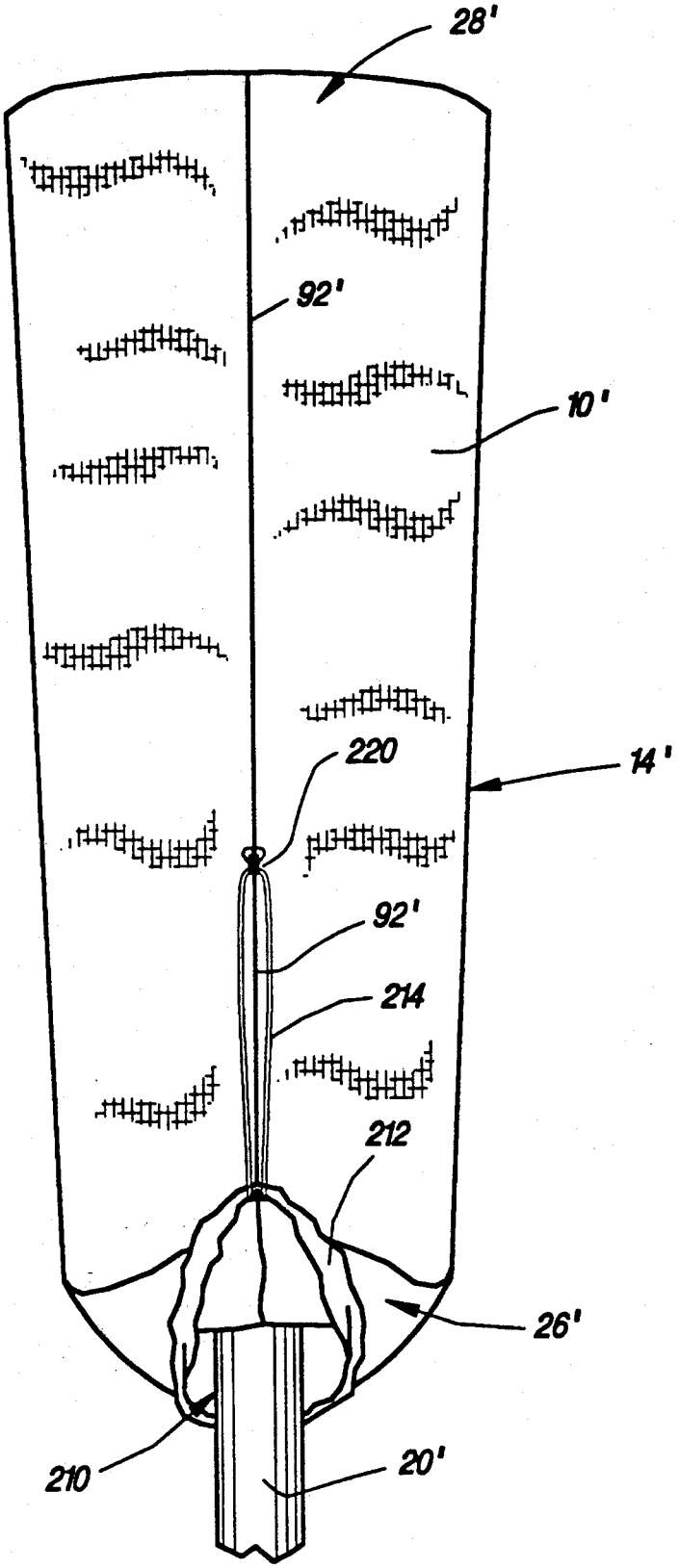
FIG. 5 is a plan view of an alternate fan blade cover.

Turning now to FIG. 5, an alternate embodiment of a fan blade cover 10' is shown mounted to a fan blade 14'. The cover 10' is also formed from an elastic material such as spandex. The tubular cover 10' has a closed end 28' and open end 26'. An opening 210 at the open end 26' is circumscribed by a narrow closed hem 212 formed by folding the material over itself and sewing the material to itself. An elastic drawstring 214 is positioned within the closed hem 212 and exits the hem at a point aligned with a seam 92' that extends along one side of the cover 10'. To mount the cover 10', the elastic band or drawstring 214 is relaxed and the opening 210 expanded so that the cover can be slipped over the blade. The user then grasps the elastic drawstring 214 and stretches it by pulling to contract the hem about the fan blade. The nowstretched drawstring is then slipped over a clasp or hook 220 that is sewn to the cover in the region of the seam 92'. To remove the cover, one releases the drawstring 214 from the hook 220 to relax the drawstring 214. The opening 210 can then be enlarged and the cover 10' slipped off the blade.

Since the fan blade covers enhance the overall appearance of the fan blades, the material may be of a variety of decorative colors and patterns, as well as capable of supporting additional decorations, such as ruffles or other appliques. The cover may also include a lining or be of the type which would allow the fan blade cover to be reversible.

While a preferred embodiment of this invention has been described in detail, it will be apparent that certain modifications or alterations can be made therein without departing from the spirit and scope of the invention set forth in the appended claims.

We claim:

1. A cover for a fan blade of a ceiling fan and which fan blade is supported by a shaft, said cover comprising:

a tubular casing having an internal surface for form fitting engagement with said fan blade when in a mounted position;

said casing having an elongated opening at one end extending in a direction substantially parallel to a longitudinal axis of said tubular casing, said opening for mounting the tubular casing on said fan blade, and said casing having a closed end spaced from the opening for covering a distal end of said fan blade; and a single zipper coupled to the casing along the elongated opening of said casing for enlarging the opening to enable the tubular casing to be slipped over the fan blade and to close the opening along the longitudinal extent of the zipper and for a portion of the opening to at least partially encircle the shaft of the fan blade to prevent movement of said casing and to maintain said casing internal surface in form fitting engagement with said fan blade during operation of said ceiling fan.

2. A cover of claim 1 wherein said tubular casing is fabricated from a flexible material that stretches to fit multiple fan blade sizes and contours.

3. The cover of claim 1 wherein said end of said tubular casing adjacent said elongated opening has closed axial end seams at laterally spaced locations on opposite sides of said elongated opening for engaging a surface of the fan blade located on opposite sides of the shaft.

4. The cover of claim 3 wherein each of said closed axial end seams is closed along the entire extent of the seam from the lateral edge of said tubular casing to said opening.

5. A cover for a fan blade of a ceiling fan and which fan blade is supported by a shaft, said cover comprising:

an elongated envelope constructed from a single layer of elastic material closed at one end and having an elongated opening extending along a portion of the envelope in a direction substantially parallel to a longitudinal axis of said elongated envelope for slipping the cover over said fan blade; and a single zipper having opposed rows of corresponding engageable taps secured to the elastic material along the elongated opening and a closure device for causing the opposed rows to engage each other along the extend of said zipper and close said opening by bringing opposite sides of said elongated opening together to at least partially encircle the shaft with a portion of the opening and thereby secure the cover to a fan blade.

6. The fan blade cover of claim 5 wherein the elastic material comprises spandex.

7. The fan blade cover of claim 6 wherein the material comprises at least 85% of a segmented polyurethane.

8. The cover of claim 5 wherein said end of said elongated envelope adjacent said elongated opening has closed axial end seams at laterally spaced locations on opposite sides of said elongated opening for engaging a surface of the fan blade located on opposite sides of the shaft.

9. A fan blade cover comprising:

a flexible tubular casing having an internal surface for form fitting engagement with a fan blade of a ceiling fan when in a mounted position;

said casing having an opening at one end of the casing for allowing said casing to be slipped onto said fan blade and a closed end spaced from the opening and associated with a distal end of said fan blade;

a drawstring coupled to the casing along the opening of said casing first end for allowing the opening to be enlarged to slip the casing over the fan blade and contracted to secure the casing to the fan blade; and a clasp mounted to an outer surface of the tubular casing to fix the drawstring in a stretched position for maintaining said casing internal surface in engagement with said fan blade during operation of said ceiling fan.

10. The fan blade cover of claim 9 wherein the casing forms a hem around the opening to support the drawstring.

11. The fan blade cover of claim 9 wherein the drawstring comprises an elastic material that stretches as it is tightened to contract the opening to secure the casing to the fan blade.

12. The cover of claim 8 wherein each of said closed axial end seams is closed along the entire extent of the seam from the lateral edge of said tubular casing to said elongated opening.

* * * * *

UNITED STATES PATENT AND TRADEMARK OFFICE

CERTIFICATE OF CORRECTION

PATENT NO. : 5,281,093

DATED : January 25, 1994

INVENTOR(S) : Sedlak et al.

It is certified that error appears in the above-identified patent and that said Letters Patent is hereby corrected as shown below:

Column 4, line 49, "taps" should read --tabs--.

Column 4, line 52, "extend" should read --extent--.

Signed and Sealed this

Twenty-fifth Day of October, 1994

*Attest:*

*Attesting Officer*

BRUCE LEHMAN

*Commissioner of Patents and Trademarks*